United States Patent [19]

Oonishi et al.

[11] 4,270,364

[45] Jun. 2, 1981

[54] FREEZING REFRIGERATOR

[75] Inventors: Toshiyuki Oonishi, Takatsuki; Takeshi Motoyama, Osaka; Kiyoshi Hatanaka, Takatsuki, all of Japan

[73] Assignee: Tokyo Shibaura Denki Kabushiki Kaisha, Tokyo, Japan

[21] Appl. No.: 95,386

[22] Filed: Nov. 19, 1979

[30] Foreign Application Priority Data

Nov. 24, 1978 [JP] Japan ..... 53-145675

[51] Int. Cl.[3] ..... F25B 41/00

[52] U.S. Cl. ..... 62/198; 62/276; 62/524

[58] Field of Search ..... 62/198, 275, 276, 524

[56] References Cited

U.S. PATENT DOCUMENTS

| | | | |
|---|---|---|---|
| 2,539,908 | 1/1951 | Jenkins | 62/198 |
| 2,706,894 | 4/1955 | Shoemaker | 62/198 |
| 2,719,407 | 10/1955 | Zearfoss, Jr. | 62/198 |
| 2,723,533 | 11/1955 | Mann | 62/198 |
| 2,746,270 | 5/1956 | Atchison | 62/276 |
| 3,950,961 | 4/1972 | Lotz | 62/198 |

FOREIGN PATENT DOCUMENTS 44-18700 8/1969 Japan .
46-29818 10/1971 Japan .
53-20197 2/1978 Japan .

*Primary Examiner*—Ronald C. Capossela
*Attorney, Agent, or Firm*—Oblon, Fisher, Spivak, McClelland & Maier

[57] ABSTRACT

A freezing refrigerator has a freezing box with side plates, top and bottom plates, and a back plate. Foodstuff products may be stored in the freezing box. The top, bottom and back plates are made of thermal conductive material. First and second envelopes are provided around the outer surfaces of the top and bottom plates. The top plate is cooled at a lower temperature by at least 5° C. than the bottom plate. A heater is disposed on the outer surfaces of the top and bottom plates for purpose of melting the frost intensively produced on the inner surface of the top plate. The outer surfaces of the top and bottom plates have hydrophilic and smooth surfaces. The outer surface of the top plate is slanted downwardly toward the back plate with an inclination at approximately 10° with respect to the horizontal surface. The defrosted water flows down along the outer surface. The outer surface of the top and back plates are provided with a receptacle for collecting water drops. The collected water is guided into the drain tube continuous to the outside of the freezing chamber.

15 Claims, 12 Drawing Figures

FREEZING REFRIGERATOR

This invention relates to a freezing refrigerator for storage of foodstuff products at low temperature, and more particularly to a freezing refrigerator of direct cooling type which causes production of frost on a specified inner surface within its freezing chamber.

In a direct cooling type refrigerator using the inner space of a box-like cooler for a freezing chamber, when much-moisture air enters the freezing chamber by opening the door, frost attaches to the inner surfaces of the freezing chamber, i.e. the entire inner surface of the box-like cooler, as well known. For defrosting, a defrosting heater is provided on the surface of the cooler. Heat generated from the heater is transferred to foodstuff products to possibly deteriorate the quality of the foodstuff products. For avoiding this, foodstuff products must be removed from the refrigerator in the defrosting operation. The foodstuff removal work is troublesome, and further makes it difficult to employ a cooling efficiency improving approach in which defrosting is automatically and periodically performed under control of a timer or the like, with keeping the average amount of the frost produced as small as possible constantly. If the defrosting is performed with foodstuff products being left within the freezing chamber, the foodstuff products comes in contact with water produced by defrosting to perhaps be dequalified.

A proposal to solve the problem is disclosed in U.S. patent application Ser. No. 14228, filed in Feb. 23, 1979 now U.S. Pat. No. 4,227,379. In the proposal, the frost is concentrated on a specific inner surface of the freezing chamber to improve the cooling efficiency of the freezing chamber. However, this proposal teaches nothing to defrost the produced frost.

Accordingly, an object of the invention is to provide a freezing refrigerator which is able to defrost the frost produced in a freezing chamber accommodating foodstuff products without dequalifying the foodstuffs.

According to the invention, there is provided a freezing refrigerator comprising: a freezing box, forming a freezing chamber for storing objects to be frozen, which is provided with side plates, top and bottom plates, and a back plate, the top plate having the inner surface being slanted downwardly toward the back plate; first cooling means provided on the outer surface of the bottom plate for cooling the bottom plate thereby to cool the space within the freezing chamber; second cooling means provided on the outer surface of the top plate for cooling the top plate at lower temperature than that of the bottom plate thereby to cool the space within the freezing chamber; heating means provided on the outer surface of the top plate for melting the frost attached onto the inner surface of the top plate; means for draining off water produced from the slanted inner surface of the top plate and flowing on the inner surfaces of the top plate and the inner surface of the back plate; and means for supplying coolant to the first and second cooling means.

This invention will be better understood from the following description taken in connection with the accompanying drawings, in which.

Figure 1:
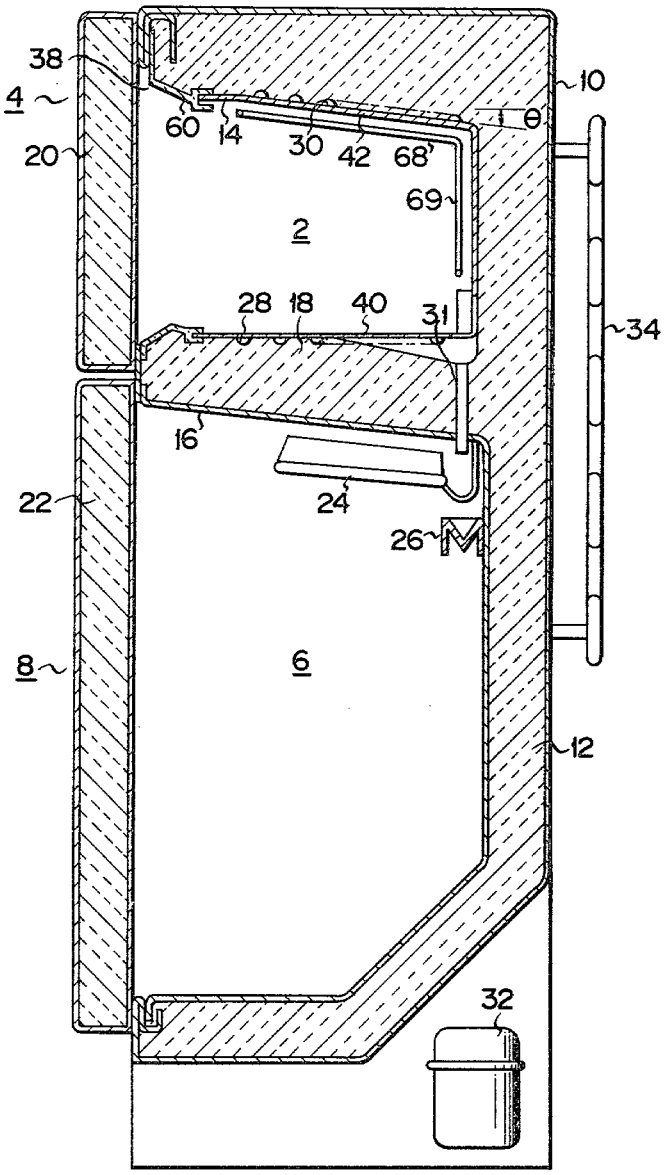
FIG. 1 shows a cross sectional view of an embodiment of a cold refrigerator with a freezing chamber according to the invention.
Figure 3:
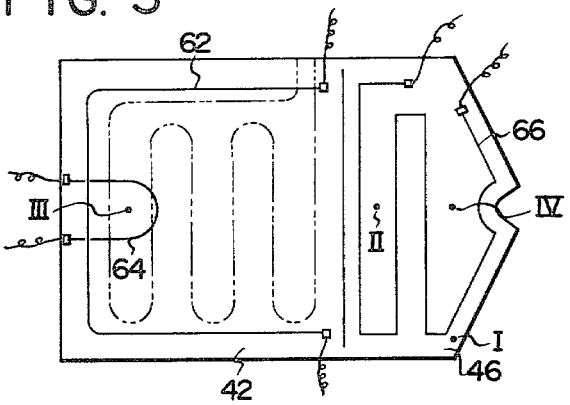
FIG. 3 shows a wiring arrangement of defrosting heated wired on the top plate of the freezing box shown in FIG. 2.
Figure 5:
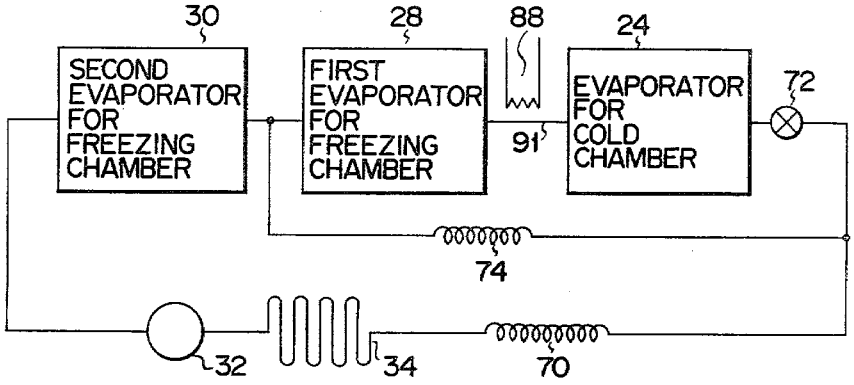
Figure 6:
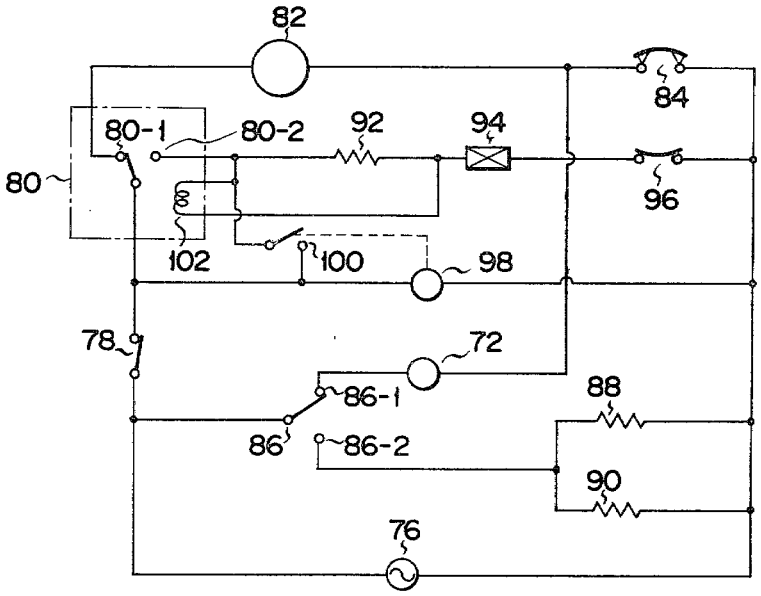
Figure 7:
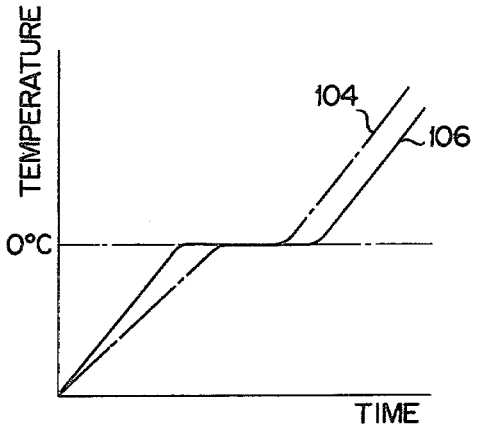
Figure 8:
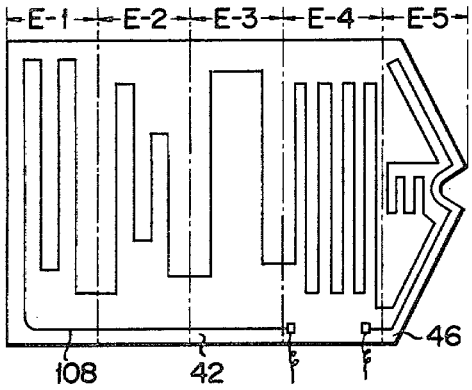
Figure 9:
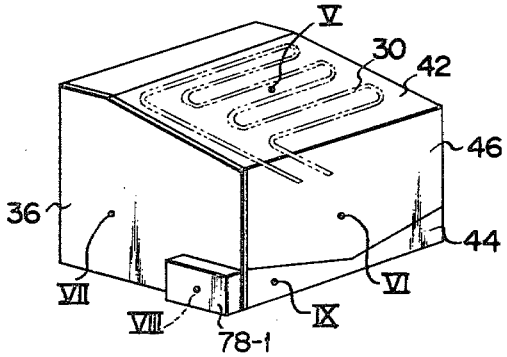
Figure 10:
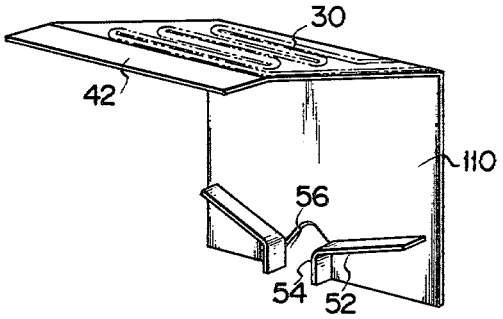

FIG. 5 schematically illustrates a freezing cycle of the cold refrigerator shown in FIG. 1;

FIG. 6 shows circuit diagram of a control circuit to control the freezing cycle shown in FIG. 5 and the defrosting heater shown in FIG. 3;

FIG. 7 shows a graph illustrating a temperature time characteristic in the areas III and IV shown in FIG. 3 in the defrosting and the freezing operations;

FIG. 8 shows another wiring arrangement of the defrosting heater;

FIG. 9 shows a perspective view of the rear side of the freezing box for illustrating a preferable arrangement of heat sensitive element of a freezing chamber temperature detecting switch used in the control circuit shown in FIG. 6;

FIG. 10 shows an exploded view of another embodiment of the freezing box; and

Figure 11:
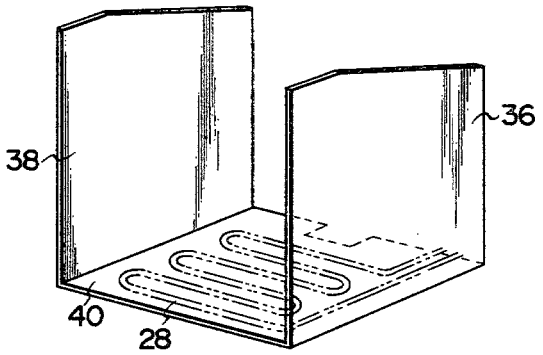
Figure 11:
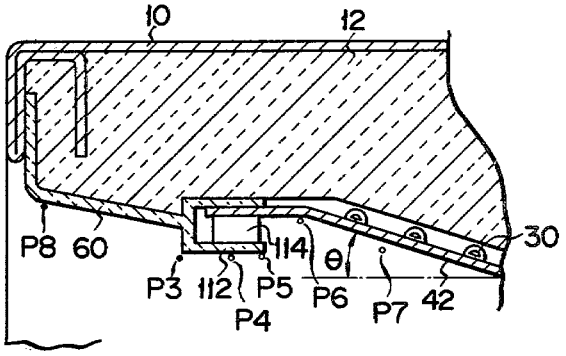
Figure 12:
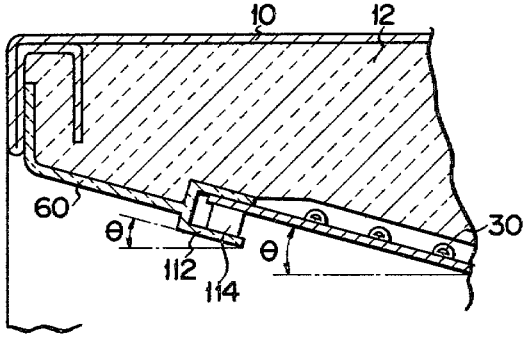

FIGS. 11 and 12 show cross sectional views of examples of an insulating frames for coupling the top plate with the outer box shown in FIG. 1.

FIG. 1 shows a longitudinal sectional view of a cooling apparatus as a preferred embodiment according to the present invention. The cooling apparatus comprises a freezing refrigerator 4 with a freezing chamber 2 and a cold refrigerator 8 with a cold chamber 6. The cooling apparatus is constructed by providing a heat insulative member 12 all over the inner surface of an outer box 10, fixing the first and second inner boxes, i.e. the freezing box 14 and the cold box 16, on the inside of the outer box 10, and placing a heat insulative member 18 between the two inner boxes. A first door 20 and a second door 22 are hinged on one of the vertical sides of the open face of the inner boxes 14 and 16, respectively. The cooling units are incorporated in the cooling apparatus in such a manner as will be described later, so that the space defined by the first door 20 and the first inner box 14 is to serve as a freezing chamber 2 of which the temperature is kept lower than that of the cold refrigerator 8 and the shape defined by the second door 22 and the second inner box 16 is to serve as the cold chamber 6. In the cold chamber 6 provided is an evaporator or cooler 24 to cool the inside of the cold chamber 6 and a dish 26 to temporarily receive and let out of the cooling apparatus water which is produced in the freezing chamber 2. The first and second coolers or evaporators 28 and 30 to directly cool the inside of the freezing chamber 2 are provided on the outer surface of the inner box 14 for the freezing chamber 2. The details of the evaporators 28 and 30 and the inner box 14 for the freezing chamber 2 will be explained later with reference to other drawings. The drain pipe 31 to draw off water produced as a result of defrosting in the freezing chamber 2 is provided through the insulative member 18. One of the ends of the drain pipe 31 is open in the freezing chamber 2 and the other end is so located that such water is led to the dish 26 across the heat insulative member 18. A compressor 32 for compressing gas coolant for conversion into high pressure and high temperature gas coolant is placed outside of the outer box 10. Behind the outer box 10 provided is a condenser 34 which radiates heat from gas coolant with high pressure at high temperature supplied from the compressor 32 to convert it into saturated liquid compressed with high pressure at high temperature.

The details of the freezing refrigerator 4 will be explained next with reference to FIG. 2 and FIG. 3.

Figure 2:
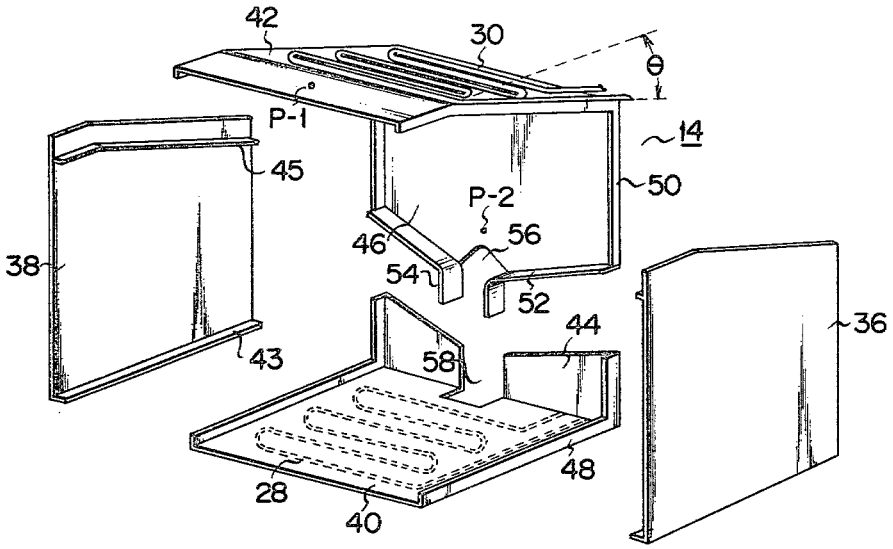
FIG. 2 shows an exploded view of one embodiment of a freezing box forming a freezing chamber of the freezing refrigerator according to the invention.

As shown in FIG. 2, the first box or freezing box 14 for the freezing chamber 2 comprises a pair of side plates 36 and 38, a bottom plate 40 and a top plate 42. The back plate of the box 14 is composed of the back portion 44 made by bending the bottom plate 40 and the back portion 46 made by bending the top plate 42 to allow smooth downward movement of water along the plates. A pair of ledges 43 and 45 are provided on the inner surface of each of the side plates 36 and 38. Flanges 48 and 50 are provided on each side edge of both the bottom plate 40 and the top plate 42. The ledge 43 is tightly fastened to the outer surface of the bottom plate 40 and the ledge 45 is tightly fastened to the outer surface of the top plate 42. The flanges 48 and 50 are tightly fastened to the inner surface of the side plates 36 and 38. A funneled portion or a substantially V-shaped ledge 52 to let drips down along is provided at the lower edge of the back portion 46 extended from the top plate 42. The funneled portion 52 has tongues 54 to let drips further down along from the inner ends of it. There is a notch 56 on the back portion 46 between the tongues 54 to help drain along it. The edge of the back portion 44 of the bottom plate 40 is so shaped that the funneled portion sits on it. The back portion 44 and the bottom plate 40 have a cutout 58 to position the tongues 54 therein. The notch 56, the cutout 58 and the tongues 54 are so located as to meet the upper end of the drain pipe 31 shown in FIG. 1. It is desirable to have the upper end of the drain pipe 31 shaped like a funnel.

The top plate 42 and the bottom plate 40 are made of metal which is good thermal conductor and easy to form such as aluminum because the first and second evaporators 28 and 30 are placed directly on the outer surface of these plates. The first and second evaporators are incorporated with the top and bottom plates by the roll-bond method or pipe-on-sheet method technique. The second evaporator 30 maintains the temperature of the inner surface of the top plate 42 at least 5° C. lower than that of the inner surface of the bottom plate 40 cooled by the first evaporator 28. To be more specific, the first evaporator 28 cools the inner surface of the bottom plate 40 down to −30° C. and the second evaporator 30 cools the inner surface of the top plate 42 down to about −35° C. The reason for cooling for the top plate 42 at a different temperature from that of the bottom plate 40 is to make the frosting mostly occur on the top plate 42 as described in the U.S. patent application Ser. No. 14,228. The side plates 36 and 38 are made of material with low thermal conductivity. The first and second evaporators 28 and 30 have evaporator path in which coolant flows and evaporates. The total volume of the path in the second evaporator 30 is so designed as to be greater than the total volume of the path in the first evaporator 28 in order to maintain that temperature difference. Further, the path in the first evaporator 28 is so designed that it is densely located in the area where ice cube formers are placed as compared with the rest area of the bottom plate 40. Specifically, the total volume of the path in the second evaporator 30 is 300 cc and that in the first evaporator 28 is 100 cc when the inside volume of the freezing chamber 2 is 60l. Thus the temperature difference of over 5° C. can be maintained.

As shown in FIG. 1 and FIG. 2, the top plate 42 excluding its front end area near the door 20 is so inclined as to allow liquid water produced by defrosting to move down along the inner surface toward the back portion 46. The angle of the inclination of the top plate 42 is to be 1° or greater under ideal conditions where liquid water produced by defrosting is in the form of uniform film rather than in the form of globules. The angle of inclination is to be 4° to 5° or greater if liquid water produced by defrosting forms globules. In consideration of possible slant mounting of the cooling apparatus at 2° to 3° and a maximum of 5°, the angle of inclination needs to be above 10° or more. The optimum angle of inclination seems to be approximately 10° because the inside volume of the freezing chamber 2 should be made as large as practicable. The inner surface of the top plate 42 ought to be smooth enough to prevent local gathering of water globules which could cause dropping. It is desirable to have the inner surface so treated as to avoid adherence of dirt and dust to it. Thus, it is that the top plate 42 be almite-made so as to have at least its inner surface possessed of the hydrophilic nature, that is, it is advisable to have oxide film of aluminum at least on the inner surface of the top plate 42. The front end area of the top plate 42 is set almost horizontally. Its front edge is connected by the heat insulative frame 60 made of plastic or the like to the outer box 10 in the same way as the front edges of the side plates 36 and 38 are connected. The front edge of the bottom plate 40 is connected by the heat insulative frame 60 to the front edge of the second inner box 16.

As shown in FIG. 3, the freezing refrigerator of the present invention has first and second defrosting heaters 62 and 64 placed on the top plate 42 and a third defrosting heater 66 on the back portion 46 of the top plate 42. As shown, the first heater 62 lies along the periphery of the top plate 42, the second heater 64 in the form of a loop extends from the front end to the center of the top plate 42, and the third heater 66 is distributed almost uniformly on the back portion 46. As will be described later, a specific example is that the capacity of the first defrosting heater is 25 watts, that of the second defrosting heater is 5 watts and that of the third defrosting heater is 70 to 80 watts, so that the ratio of the total capacity of the first defrosting heater and the second defrosting heater to that of the third defrosting heater is approximately 3 to 7.

Figure 4:
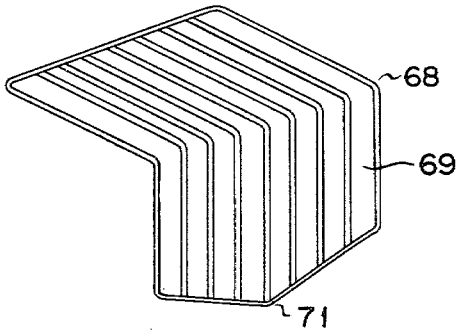
FIG. 4 shows a perspective view of a safety guard shown in FIG. 1.

Referring to FIG. 1 again, a so-called guard plate 68 shown in FIG. 4 is placed in the freezing chamber 2 so that foodstuff products stored in the freezing chamber 2 is prevented from contacting the top plate 42 directly. This guard plate 68 is located with a narrow gap between the top plate 42 and the plate 68. A back portion 69 of the plate made by bending it is located with a narrow gap similar to the above one between the back portion 46 of the top plate 42 and the back portion 69 of the grating. The lower end of the back portion 69 of the plate is V-shaped similarly to the back portion 46 of the top plate 42. The lowest point 71 of the lower end of the plate is located right above the open end of the drain pipe 31. The surface of the guard plate 68 at least where it faces the top plate 42 should be treated to make it hydrophilic by providing oxide film of aluminum on it, because such hydrophilic surface will be able to let any water drops move down along toward the open end of the drain pipe 31 if the drops come from the inner surface of the top plate 42 down to the guard plate 68. It is desirable to have the guard plate 68 made of non-heat conductive material to prevent frosting on its surface. The other components required to embody the present invention are illustrated in FIG. 5 of a schematic diagram of refrigeration cycle and FIG. 6 of a control circuit diagram. The specific positional relationships of these components are not given in FIGS. 1 and 3 because the relationships are made easily understandable to these skilled persons in the art.

A freezing cycle of the freezing refrigerator according to the invention will be described with reference to FIG. 5. In FIG. 5, the compressor 32 is connected to the evaporator 24 for the cold chamber 6, through the condenser 34, a main capillary tube 70 and a magnetic valve 72. The evaporator 24 for the cold chamber is coupled again with the compressor 32, through the first and second evaporators 28 and 30 for the freezing chamber. As shown in the figure, an auxiliary capillary tube 74 is inserted between the outlet of the main capillary tube 70 and the inlet of the second evaporator 30. Those components shown in FIG. 5 are well known and therefore the details of them will be omitted. For further details, reference should be made to the U.S. patent application Ser. No. 14,228.

A control circuit for controlling the freezing cycle as shown in FIG. 5 will be described with reference to FIG. 6. As shown, an AC power source 76 is connected to a compressor motor 82 for driving the compressor 32, through a freezing chamber temperature detecting switch 78 which detects the temperature within the freezer 4, i.e. the freezing chamber 2, to be closed when the temperature of the freezing chamber 2 falls below a preset temperature, and a normally close contact 80-1 of the relay 80. The motor 82 is connected to the power source 76 again, through an excessive current protecting switch 84 which turned off in response to an excessive load current. The first contact 86-1 of a cold chamber temperature detecting switch 86 for detecting temperature within the cold chamber 6 is closed when it detects a temperature above a preset temperature. The first contact 86-1 of the cold chamber temperature, which is turned on when it detects a temperature above the preset temperature, is connected to a junction point between the motor 82 and the switch 84 through the power source 76. The second contact 86-2 of the cold chamber temperature, which is turned on when it detects a temperature below the preset temperature, is connected to the power source 76, through a parallel circuit having a coupling tube heater 88 and a drain tube heater 90. The coupling tube heater 88 is mounted to a coupling tube 91 (shown in FIG. 5) coupling the evaporator 24 for the cold chamber with the first evaporator 28 for the purpose of preventing the outer surface of the coupling tube from being frozen. The drain tube heater 90, provided around the drain tube 3, prevents the drain tube from being frozen. The normally open contact 80-2 of the relay 80 is connected to a defrosting heater unit 92 having the first, second and third defrosting heaters 62, 64 and 66, a temperature fuse 94 melted when the freezer is abnormal in operation, and a defrosting complete temperature switch 96 which is closed when it detects that the frost of the top plate 42 is defrosted by the heaters 62, 64 and 66 and its surface temperature rises at the predetermined temperature. A defrosting timer 98 is provided with a timer switch 100 connecting through the switch 78 to the power source 76. The relay coil 102 is connected at one end to the normally open contact 80-2 and to the power source 76 through the timer switch 100 and the switch 78 while at the other end to the junction point between the defrosting heater unit 92 and the temperature fuse 94. In the embodiment under discussion, the defrosting timer 98 repeats a short-time close of the switch 100 every 24 hours. The temperature fuse 94 is disposed at the front center P-1 of the second evaporator 30 as shown in FIG. 2. The defrosting complete temperature switch 96 is disposed in the vicinity of the lowermost part P-2 of the back portion 46 through which the defrosted water is frowed.

The operation of the freezing cycle and the control circuit shown in FIGS. 5 and 6 will be described. When the temperatures within the cooling and freezing chambers 2 and 6 are above the preset values, the freezing chamber temperature detecting switch 78, the first contact 86-1 of the cold chamber temperature detecting switch 86 and the normally close contact 80-1 of the relay 80 are all closed. Under this condition, electromagnetic valve 72 is in current-passage condition and the compressor motor 82 runs. Accordingly, the liquid coolant discharged from the condenser 34 flows through the main capillary tube 70, the electromagnetic valve 72, the evaporator 24, the first cooler 28, and the second cooler 30 in this order. In this case, the serial coolant passage resistance having the electromagnetic valve 72, the evaporator 24 and the first cooler 28 is smaller than the passage resistance of the capillary tube 74, so that little liquid coolant passes through the capillary tube 74. In this way, the evaporators 24, 28 and 30 cool the insides of the freezing and cold chambers 2 and 6, so that the temperatures within the chambers 2 and 6 gradually fall. As the temperature in the cold chamber 6 falls to be the set temperature, the switch 86 detects the temperature to open the first contact 86-1 and to close the second contact 86-2. As a result, no current is fed to the electromagnetic valve 72 while current is fed to the coupling tube heater 88 and the drain tube heater 90. By closing the electromagnetic valve 72, the liquid coolant discharging from the main capillary tube 70 passes through the capillary tube 74 and enters only the second evaporator 30 of the freezer 2, so that the freezing in the freezer 2 continues. When the temperature in the freezer 2 falls below the set temperature, the switch 78 opens to stop the current feed to the compressor motor 82. At this time, one cycle of the freezing operation by the compressor 82 completes. When the temperature in the freezing chamber 2 rises above the set temperature, the switch 78 is closed, so that the compressor 82 is operated again and the chamber temperature control commences as mentioned above. In connection with the freezing cycle, when the liquid coolant passes through either the electromagnetic valve 72 or the auxiliary capillary tube 74, the second evaporator 30 is always supplied with the coolant. Further, the total volume of the path of the evaporator 28 is larger than that of the first evaporator 30 and therefore, the temperature of the second evaporator 30 is kept to be lower than the first evaporator 28 by 5° C. or more. There, when much-moisture air enters the freezer 2 by opening the door 20, the more amount of frost attaches to the second evaporator 30 or the top plate 42 than that to the first evaporator 28 or the bottom plate 40. At this time, a small amount of frost is produced on the first evaporator 28; however, the frost is transferred to the second evaporator 30 by the sublimation.

Explanation will be given of how to melt away the frost attached to the second evaporator 30. The defrosting timer 98 is conducted during a period that the switch 78 is closed. Accordingly, it always accumulates the operation time of the compressor 82. As a result, every time that the total time of the operation of the timer 98, or that of the operation of the compressor motor 82, the timer switch 100 is closed for a short time. This operation is repeated. The operation time of the time switch 100 depends on seasons. In fact, the timer 100 is set to operate approximately once for 24 hours, in average. When the timer switch 100 is closed, the relay coil 102 is conducted to close the normally close contact 80-1 and to close the normally open contact 80-2. Subsequently, the relay coil 102 is self-sustained to stop the power supply to the compressor motor 82. As a consequence, during the self-sustaining period, the defrosting heater unit 92, or the first defrosting heater 62, the second defrosting heater 64 and the third defrosting heater 66 are supplied with current. Then, the defrosting operation of the second evaporator 30, or the top plate 42, commences. The defrosted water flows down along the top plate 42, without being split therefrom, to the back portion 46. The water flows along the back portion 46 and is guided by the water guiding portion, or the funnel portions 52 into the drain port of the drain pipe 31 and then into the dish 26. The use of the alumite for the inner surface of the top plate 42 further reliably prevents the water from spilling from the top plate 42 in its flow way. The water flowed down along the funnel portion 52 to effectively drained by the cutout portion 56 when it reaches the tongues 54. When the frost produced on the top plate 42 is completely defrosted in this way, the surface temperature of the second evaporator 30 abruptly rises. Accordingly, the defrosting complete temperature switch 96 for detecting the surface temperature is opened to release the self-sustaining of the relay coil 102 and then to shut off the defrosting heater 92. Consequently, the freezing cycle is restored to be in a normal operation.

In the freezing chamber 2 controlled in this way, most of the frost is produced on the top plate 42 seldom contacting the foodstuff products stored therein; the top plate 42 is slanted down backwardly to permit the defrosted water to flow down to a specific portion in natural way, in order that the defrosted water does not spill into the freezing chamber 6. Therefore, even if the defrosting operation is performed while the stored foodstuff products is stored, the stored foodstuff products are never subject to the defrosting heat or never contact the water. As a consequence, there is eliminated the deterioration of the stored foodstuff products arising from the defrosting operation.

As seen from the foregoing, the defrosting operation is performed periodically under control of the defrosting timer 98 irrespective of the presence or absence of the stored foodstuff products, while constantly reducing the average amount of the frost produced. Therefore, the freezing efficiency of the freezer 2 is improved.

The measured values of the above-mentioned embodiment will be described.

(i) In a normal operating condition where the freezing cycle is automatically and intermittently performed, the average temperatures measured at the respective portions are: about −24° C. for the temperature at the central portion in the freezing chamber; about −33.8° C. for the temperature at the top plate 42; about −25.8° C. for the temperature of the bottom plate 40 with the first evaporator 25 mounted thereto; about +0.1° C. for the temperature in the cold chamber 6. As seen from the measured values, there is about 8° C. of the temperature difference between the temperatures at the top and bottom plates 42 and 40 having respectively the second evaporator 30 and the first evaporator 28. Therefore, 5° C. or more necessary for the transfer of the frost from the bottom plate 40 to the top plate 42 due to the sublimation may be obtained sufficiently.

(ii) Frosting Ratio and Sublimation Amount

Frost is intentionally formed in the freezing chamber 2 by opening and closing the door 20. The result was that 90% of the total amount of the frost is formed on the top plate 42 and 10% of it on the bottom plate 40. In the sublimation of the frost attached to the bottom plate 42, the frost of 0.8 g over the area of 731 $mm^2$ is sublimated by 0.0025 g for an hour in the closed condition of the door 11. The amount of sublimation for a day, when the bottom area of the bottom plate 40 is 0.182 $m^2$, is 7.98 g.

(iii) Temperatures at the Respective Portions in Defrosting

The output values of the first, second and third defrosting heaters 62, 64 and 66 were determined depending on the requirement that the frost amount (calculated in terms of the melted water) of 65 cc must be removed for 30 minutes. The output of the first to third defrosting heaters 62, 64 and 66 were 25 W for the first heater, 5 W for the second heater and 80 W for the third heater. In this case, the temperature in the vicinity of the drain port (the lower portion of the tongues 54) rises about +15° C. for 30 minutes. The temperatures in the areas I and II shown in FIG. 3 of the back portion 46 rises faster than that of the former, to reach 0° C. from −30° C. after 10 minutes and to reach +20° C. after 30 minutes. Generally, it is sufficient for the defrosting that the temperature of the back portion 46 rises to about +15° C. Therefore, the output of the third defrosting heater 66 of the back portion 46 may be 80 W or less, for example, 70 W. In other words, the input for the heater 66 may be reduced further.

FIG. 7 shows a temperature characteristic in the areas III and IV in FIG. 3 of the second evaporator at the time of the defrosting. In the figure, one dot chain line 104 indicates a temperature characteristic in the area III and a continuous line 106 represents a temperature characteristic in the area IV. To be more specific, most of the frost is formed in the vicinity of the top plate 42 near the door, so that the time taken for melting the frost of the top plate 42 is longer than that for the back portion 46, with the result that the time taken for the temperature in the area IV to reach 0° C. is longer than that for the area IV. However, once it reaches 0° C., the defrosted water on the top plate 42 falls down to the back portion 46 to disappear and then the freezing preventive operation of the frosted water or the melting operation of the same is performed at the back portion 46. Therefore, the temperature rise at the back portion is slower than that on the top plate 42. The temperature rise after it reaches 0° C. in the area III is faster than that in the area IV.

Accordingly, if the temperature rise rates of the two areas are substantially equal to each other, the heat influence upon the chamber is reduced. The measurement values of the embodiment in connection with this were: −30.4° C. and −31.5° C. in the areas III and IV shown in FIG. 3 of the second evaporator 30 become respectively −4° C. and −2.4° C. after 10 minutes; 0° C. and +4.5° C. after 20 minutes and +10.8° C. and +11.5° C. after 30 minutes. The temperature rise rates in both the areas are substantially equal to each other. It is evident that the temperature rise in the area III slightly changes depending on the frosting state.

Turning now to FIG. 8, there is shown a distribution of the heater 108 on the upper plate 42 when only a single defrosting heater 108 is provided on the upper plate 42. As shown, the density of the defrosting heater 108 gradually becomes low on the upper plate 42, as it goes from front side to the rear side. In the distribution of the defrosting heater 108, the E-1 area has 13 W, the E-2 area 11 W, and the E-3 area 6 W. Also in the defrosting heater 108 distribution on the back portion 46, the area E-5 in the vicinity of the drain port and the tongues 54 has 14 W, and the remaining area E-4 has 32 W. In the defrosting of the top plate 42, the defrosted water commence in contact with the front when it flows from the front side to the rear side. Therefore, the distribution of the heater changing its density from high to low as it goes to the rear side, goes well with this.

In FIG. 9, there is shown an example that the switch 78 is disposed at a preferable position in the freezing chamber 2. The freezer 4 is the same construction as that of the first embodiment. The temperatures at the respective portions of the freezer 4 when the freezing cycle is executed intermittently are: −31.1° C. in the area V; −34.3° C. in the area VI; −25.3° C. in the area VII; −25.3° C. in the area VIII; −26.0° C. in the area IX; −28.1° C. of the air in the center of the freezing chamber 2. In this example, the heat sensitive element 78-1 of the freezing chamber detecting switch 78 is disposed in the area VIII where is the lowest temperature are in the freezing chamber 2, or the lower back portion of either the side plates 36 or 38. When the first evaporator 28 and the second evaporator 30 with a lower preset temperature than that of the first one are controlled by the single freezer temperature detecting switch 78 having only one heat sensitive element 78-1, it is desirable to dispose the heat sensitive element 78-1 in the highest temperature area VII within the freezing chamber 2.

Another embodiment of the freezing box 14 is shown in FIG. 10, in which the side plates 36 and 38 and the bottom plate 40 are formed integrally and the back portion 110 is formed by bending the top plate 42. The funneled portion 52 may be separately formed and implanted in the back portion 110.

The coupling structure between the insulating frame 60 shown in FIG. 1 and the leading edge of the top plate 42 will be described in detail referring to FIG. 11. The insulating fraame 60 has a U-shaped portion 112 into which the leading edge of the upper plate 42 are inserted, together with an adiabatic holding member 114 such as urethane slug. In this way, the top plate 42 is tightly held at the leading end between the frame 60 and the holding member 114. Particularly, the adiabatic holding member 114 is placed under the leading edge of the upper plate 42 within the U-shaped portion 112. In the normal freezing cycle to keep a proper temperature with the structure just mentioned, the temperature measured at the respective portions shown in FIG. 11 are: −8° C. at the P-3 portion; −8.9° C. at the P-4 portion; −9.1° C. at the P-5 portion; −26.1° C. at the P-6 portion; −22.2° C. at the P-7 portion; +13.8° C. at the P-8 portion. As seen from those measured values, the temperature difference between the portions P-3 and P-6, that is to say, the rear end of the insulating frame 60 and the portion adjacent the insulating frame 60 of the top plate 42 is 17° C. This fact indicates that, when the water drops are produced on the lower surface of the U-shaped portion 112 of the insulating frame 60, and those are frosted, those are transferred from the lower surface of the U-shaped portion 112 to the top plate 42, so long as the defrosting operation is periodically performed under control of the defrosting timer 98.

Turning now to FIG. 12, there is shown a modification of the coupling structure in FIG. 11. In this example, the insulating frame 60 is so designed that the lower surface of the U-shaped portion 112 of the frame 60 is downwardly slanted with much the same inclination angle $\theta$ as that of the top plate 42. With this construction, the water condensated on the lower surface of the U-shaped portion 112 flows down toward the top plate 42 along the slanted surface, thereby to effectively prevent the frosting at the rear end portion of the insulative frame 112.

In the embodiment shown in FIG. 11, a good thermal conductivity metal member in contact with a high temperature coolant gas passing pipe derived from the compressor 32 is disposed near the U-shaped portion 112 of the insulating frame 60, thereby to effectively melt the frost produced in the U-shaped portion 112.

As described above, in the freezing refrigerator according to the invention, frost is formed on the top plate of the freezing chamber of freezer. When the frost melt into water, the water flows down, never falling in drops from the top plate onto the food. Therefore, even if the defrosting is performed while the foods and stored therein, the foods and never deteriorated by the defrosting heat and defrosting water. Consequently, irrespective of the storage of the foods, the defrosting operation is made periodically by the timer, for example, with constantly reducing the average amount of the frost in the freezing chamber, thereby improving the cooling efficiency.

What we claim is:

1. A freezing refrigerator comprising:

a freezing box, forming a freezing chamber for storing objects to be frozen, which is provided with side plates, top and bottom plates, and a back plate, the top plate having the inner surface slanted downwardly toward the back plate;

first cooling means provided on the outer surface of said bottom plate for cooling said bottom plate thereby to cool the space within said freezing chamber;

second cooling means provided on the outer surface of said top plate for cooling said top plate at lower temperature than that of said bottom plate thereby to cool the space within said freezing chamber;

heating means provided on the outer surface of said top plate for melting the frost attached onto the inner surface of said top plate;

means for draining off water produced from the slanted inner surface of said upper plate and flowing on the inner surface of said top plate and the inner surface of said back plate; and means for supplying coolant to said first and second cooling means.

2. A freezing refrigerator according to claim 1, wherein said top, bottom and back plates are made of good thermal conductivity material.

3. A freezing refrigerator according to claim 1, wherein said second cooling means cools the inner surface of said top plate at lower temperature by at least 5° C. than said first cooler cools the inner surface of said bottom plate.

4. A freezing refrigerator according to claim 1, wherein the inclination angle of the inner surface of said top plate is 1° or more.

5. A freezing refrigerator according to claim 1, wherein the inclination angle of the inner surface of said top plate is approximately 3° or more.

6. A freezing refrigerator according to claim 1, wherein the inclination of the inner surface of said top plate is approximately 1° or more.

7. A freezing refrigerator according to claim 1, wherein said water discharge means includes a receptacle for collecting water drops provided on the inner surface of said back plate, and a drain tube for draining the water to the outside of said freezing chamber from the receptacle.

8. A freezing refrigerator according to claim 1, wherein said first cooling means is a first evaporator integrally formed on the outer surface of said bottom plate with a first evaporator path through which coolant passes, and said second cooling means is a second evaporator integrally formed on the outer surface of said top plate and having a second evaporator path with a larger volume than that of the first evaporator path, through which coolant passes.

9. A freezing refrigerator according to claim 1, wherein the inner surface of said top plate is a smooth surface with hydrophilic nature.

10. A freezing refrigerator according to claim 1, wherein said back plate is integral with said top plate and the bent portion of said top plate forms at least part of said back plate.

11. A freezing refrigerator according to claim 1, wherein said heating means is provided on the outer surface of said back plate.

12. A freezing refrigerator according to claim 11, wherein said heating means produces at the outer surface of said back plate a larger heat amount than that produced from the outer surface of said top plate.

13. A freezing refrigerator according to claim 1, further comprising a guard plate made of thermal non-conductive member which is disposed in a gap between the inner surfaces of said top and back plates and has a surface facing the hydrophilic and smooth inner surface thereof.

14. A freezing refrigerator according to claim 1, further comprising a control means including a timer for periodically controlling said heating means.

15. A freezing refrigerator according to claim 14, wherein said control means includes defrosting-complete detecting means to stop said heating means when the inner surface of said top plate is defrosted and the surface temperature thereof reaches a given temperature.

* * * * *